US006746997B2

(12) United States Patent
Carr et al.

(10) Patent No.: US 6,746,997 B2
(45) Date of Patent: Jun. 8, 2004

(54) ALKYLARYL-O-ETHOXYLATE BLENDS WITH THEIR RESPECTIVE SULFATES

(75) Inventors: Charles D. Carr, Yardley, PA (US); Archana Gupta, Princeton, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 79 days.

(21) Appl. No.: 10/233,749

(22) Filed: Sep. 3, 2002

(65) Prior Publication Data

US 2004/0092422 A1 May 13, 2004

(51) Int. Cl.[7] ..... C11D 1/29; C11D 1/83; C11D 1/69; D06L 1/00

(52) U.S. Cl. ..... 510/356; 510/360; 510/392; 510/421; 510/424; 510/475; 510/492; 510/505; 510/535; 8/137

(58) Field of Search ..... 510/356, 360, 510/392, 421, 424, 475, 492, 505, 535; 8/137

(56) References Cited

U.S. PATENT DOCUMENTS 2,941,950 A 6/1960 Korpi et al.
3,309,392 A 3/1967 Roele
3,413,331 A 11/1968 Beiser et al.
3,755,407 A 8/1973 Wilkes
3,869,399 A 3/1975 Collins
3,920,586 A 11/1975 Bonaparte et al.
3,959,186 A 5/1976 Harris
4,052,342 A 10/1977 Fernley et al.
4,137,197 A 1/1979 Kowalchuk
4,162,994 A 7/1979 Kowalchuk
4,224,195 A 9/1980 Kawasaki et al.
4,265,790 A 5/1981 Winston et al.
4,464,292 A * 8/1984 Lengyel ..... 510/351
4,759,877 A * 7/1988 Hildreth et al. ..... 510/329

OTHER PUBLICATIONS

Derwent Abstract for Japanese 52022007 A Feb. 19, 1997.

* cited by examiner

*Primary Examiner*—Brian P. Mruk

(57) ABSTRACT

A process for the preparation of mixed ethoxylated alkyl phenol/alkyl phenol ethoxy sulfate surfactants, such surfactants, and detergent formulations incorporating the same. The mixed surfactants are more tolerant of sodium carbonate, allowing greater amounts of sodium carbonate to be used so that the amount of surfactant can be reduced resulting in overall cost savings in the resultant laundry product.

17 Claims, No Drawings

ALKYLARYL-O-ETHOXYLATE BLENDS WITH THEIR RESPECTIVE SULFATES

CROSS-REFERENCE TO RELATED APPLICATIONS

Not Applicable

STATEMENT REGARDING FEDERALLY SPONSORED RESEARCH OR DEVELOPMENT

Not Applicable

FIELD OF THE INVENTION

This invention relates to a process for the preparation of mixed ethoxylated alkylphenol/ethoxy sulfate surfactant systems, to the surfactants thus produced, and to synthetic detergent formulations incorporating the same. In particular, it relates to the preparation of ethoxylated alkylphenol/sulfated ethoxylated alkylphenol surfactant blends providing low cost, low capital, low-energy intensive laundry detergents which exhibit both good cleaning and sudsing characteristics.

BACKGROUND OF THE INVENTION

The manufacture and use of synthetic laundry detergents containing mixtures of nonionic and anionic surfactants has been documented in the patent literature. See, for example, Bonaparte et al. U.S. Pat. No. 3,920,586 and Lengyel et al U.S. Pat. No. 4,464,292 (both of which are incorporated herein by reference in their entirety). Moreover, the use of ethoxylated alcohols (referred to herein, for convenience, by the "EA" acronym) as the nonionic constituent of such mixtures, and ethoxy sulfates (referred to herein by the "ES" acronym) as the anionic constituent of such mixtures has also been described (see the aforesaid Bonaparte patent, column 2, lines 32–37; column 3, lines 17–28; column 9, lines 30–45; and column 9, line 67 column 10, line 20).

Dry blended laundry detergents containing such EA/ES or other nonionic/anionic surfactant systems are further described, for example, in Winston et al. U.S. Pat. No. 4,265,790 (incorporated herein by reference. In the past, however, when for cost purposes EA's have been utilized as the nonionic constituent of such surfactant systems, the sudsing characteristics of the resulting dry blended detergent formulations have been impaired. Moreover, the use of EA/ES surfactant systems in dry blended detergent powders has been said to interfere with the processing characteristics thereof. Various efforts have been made to improve such processing characteristics. See, for example, Kowalchuk U.S. Pat. Nos. 4,137,197, and 4,162,994, both of which are incorporated herein by reference.

It has also been suggested in the patent literature that EA/ES mixtures useful in detergent compositions may be prepared by the direct sulfation of various EA materials. See, for example, Roele U.S. Pat. No. 3,309,392, and Harris U.S. Pat. No. 3,959,186 (both incorporated herein by reference). The Roele patent describes a two-stage, gas phase reaction for the sulfation of EA's having at least 8 carbon atoms with sulfur trioxide/inert gas mixtures. The final products, which are said to be useful as detergents, wetting agents or the like, are sulfated with conversions ranging from 87 to 97%.

The Harris patent, on the other hand, describes the sequential partial sulfation of, first, a highly ethoxylated EA (incorporating from 8 to 25 moles of ethoxylate per mole of the alcohol) and, thereafter, a less ethoxylated compound (incorporating from 2 to 12 moles of ethoxylate per mole of alcohol, but at least 4 ethoxylate groups per mole less than the EA first sulfated). Harris further discloses that, after neutralization of the partial sulfate mixture thus produced, the resulting product may contribute both detergent and builder properties to dry detergent formulations. Detergents incorporating the same are said to be capable of dispersing lime soap and to possess satisfactory washing characteristics as compared with other commercial dry powder detergents.

Lengyel et al, U.S. Pat. No. 4,464,292 discloses sulfation of (a) a blend of an alcohol and an alkyl ethoxylate or (b) a blend of an alkylaryl-OH (AAr) and an alkylarylethoxylate (AArE) and the use of the blend of the sulfated and unsulfated product which results in laundry detergents. While Lengyel mentions the degree of ethoxylation generally can be from 1–12 ethoxy units, only the alkyl ethoxylates are mentioned specifically with ethoxylations of less than 8 units. The only alkylaryl-O-ethoxylates mentioned have 8–10 ethylene oxide units per mole of alkylaryl-OH.

Although the art surfactant systems provide workable laundry detergent products, the laundry detergent area is a very cost conscious field and there are always efforts at developing lower cost alternatives that provide the same or better cleaning products. In addition, cost savings are also sought in manufacturing processes by eliminating steps or reducing energy demands, etc. meeting these goals takes on additional challenges when dealing with liquid formulations as components which might not interact when in a powder formulation may adversely interact in liquid formulations. Furthermore, liquid formulations may separate on storage, especially when subjected to extremes of temperature as may be encountered in the normal commercial distribution chain.

OBJECTS OF THE INVENTION

It is among the objects of the present invention to provide an improved process for the preparation of mixed AArE/AArES surfactants, which process may be efficiently and inexpensively carried out.

Another object of the invention is to provide a liquid laundry product which has improved stability while maintaining desired viscosity, performance, and soda ash loading.

A further object is to provide such surfactants, and detergents incorporating the same, which exhibit the detergency (cleaning) and esthetic (whiteness) characteristics required of commercial laundry detergents and which, moreover, have substantially improved sudsing characteristics.

It is a further object of the invention to provide a detergent which is more tolerant of high soda ash content, especially in liquid detergent formulations, than otherwise.

Yet another object of the invention is to provide a detergent formulation, especially a liquid detergent formulation, which has an increased soda ash content so as to permit a reduced surfactant content and thereby reduce overall detergent cost.

Still other objects of the invention will be recognized by those of ordinary skill in the art.

BRIEF SUMMARY OF THE INVENTION

These objects are surprisingly achieved by the utilization of a mixture of alkylaryl-O-ethoxylates and the corresponding sulfates thereof as the surfactant portion of a high soda ash content laundry detergent, especially a high soda ash liquid laundry detergent. The mixture of alkylaryl-O-ethoxylates (which is then partially sulfated) is of the formula:

$$C_{6-12}\text{alkyl-}C_{6-10}\text{aryl-O—}(CH_2CH_2O)_nOH \quad (I)$$

where there is at least one component where n is 1–6 (the low ethoxylate component) and at least one component where n is 7–12 (the high ethoxylate component). This mixture is then partially sulfated generally in the manner shown by Lengyel (except that there is no free alkylaryl-OH). The at least 4 part mixture (of the low ethoxylate component, the high ethoxylate component, and their respective sulfates) is then used in amounts of up to about 50% of the formulation of a laundry detergent, especially a liquid laundry detergent.

BRIEF DESCRIPTION OF THE DRAWING

Not Applicable

DETAILED DESCRIPTION OF THE INVENTION

Ethoxylated aryl alcohols which are partially sulfated in the practice of this invention have the formula $$C_{6-12}\text{alkyl-}C_{6-10}\text{aryl-O—}(CH_2CH_2O)_nOH \quad (I).$$

The $C_{6-12}$alkyl group is preferably selected from alkyl groups of 7–11 carbon atoms, more preferably 8–10 carbon atoms, and still more preferably is nonyl. It may be straight or branched, but straight chains are preferred. The $C_{6-10}$aryl group is preferably phenyl or naphthyl, with phenyl being preferred. The number of ethoxy units (n) in the low ethoxy component is about 1 to about 6, preferably about 1.5 to about 5.5, more preferably about 2 to about 5, still more preferably about 3 to about 4, and most preferably about 4. The number of ethoxy units (n) in the high ethoxy component is about 7 to about 14, preferably about 8 to about 12, more preferably about 9 to about 10, and most preferably about 9. While the most preferable mixture to be used for partial sulfation in the present invention is a mixture where the low ethoxylate component has n=4 and the high ethoxylate component has n=9, other mixtures are suitable as well. Furthermore, while the most preferred mixture for sulfation in the instant invention has the $C_{6-12}$alkyl group in the low and high ethoxylate components as the same, the present invention is not so limited, and the low ethoxylate component and the high ethoxylate component need not have the same $C_{6-12}$alkyl group. Similarly, the points of attachment of the $C_{6-12}$alkyl and the ethoxylated hydroxy on the $C_{6-10}$aryl need not be the same in the low and high ethoxylate components, however, it is preferred if they are the same, and while any substitution arrangement of the aryl (such as o, m, or p when the $C_{6-10}$aryl is phenyl) is acceptable, a para relationship is preferred between the $C_{6-12}$alkyl group and the ethoxylated hydroxy (the analogous substitution patterns are preferred when the $C_{6-10}$aryl is naphthyl). While preferable that there be no other substitutions on the $C_{6-10}$aryl group, there is no requirement that there be none, and additional substitutions which do not negatively impact the ability to preferentially partially sulfate the free end of the ethoxy chain and do not materially adversely affect the detergency action of the component are acceptable.

Although the preferred blend which is subject to sulfation in the present invention is intended to be a binary mixture of one low ethoxylate component and one high ethoxylate component, it is recognized that in many instances, the "allegedly single chemical materials" are in actuality a mixture of materials having a relatively narrow range of ethoxy groups, with the major portion being the stated component. As such, the invention specifically includes those embodiments where there is more than one low ethoxylate component and/or more than one high ethoxylate component which mixture is then subjected to partial sulfation in the present invention. As used throughout the rest of this disclosure and claims, the term "binary mixture" refers to a mixture in which there are two components which are either pure chemicals or in one or both of such components there is a single chemical which is the major constituent amongst a blend of homologs thereof.

The most preferred binary mixture which is subjected to the partial sulfation of the instant invention is a mixture of nonylphenol ethoxylate (4 mole) and nonylphenol ethoxylate (9 mole), the number of moles in parentheses referring to the number (on average) of ethoxy units per mole of compound. Most preferably the nonyl group is, relative to the ethoxylated hydroxy, in a 1,4-relationship (para arrangement) when the aryl is phenyl.

The ratio of the high ethoxylate component to low ethoxylate component may vary over wide ranges as desired, but is typically in a weight ratio of from 90:10 to 10:90, more preferably from about 85:15 to about 60:40, more preferably about 80:20 to about 65:35, still more preferably from about 75:25 to about 70:30, most preferably about 75:25 (high ethoxylate component:low ethoxylate component). In this context, "the high ethoxylate component" means the total of sulfated as well as unsulfated high ethoxylates and the "low ethoxylate component" means the total of sulfated and unsulfated low ethoxylates.

The above blends that are to be subjected to sulfation in the present invention are then sulfated by reacting it with sulfuric acid, preferably concentrated sulfuric acid, most preferably at least 99% sulfuric acid, in a molar ratio of sulfric acid to alkylaryl-O-ethoxylate of about 0.2:1 to about 1.5:1, more preferably 0.5:1 to about 1.25:1, still more preferably about 0.75:1 to about 1.1:1, even more preferably about 0.9:1 to about 1:1, most preferably about 1:1. The resulting mixture (each ethoxylate component is partially sulfated to a mixture of unsulfated and sulfated forms of each ethoxylate constituent of the pre-reaction mixture) is then quenched with a suitable base, preferably sodium hydroxide to neutralize any remaining acid. (The pre-neutralized partially sulfated materials may be used directly as is if the detergent formulation will contain sufficient alkaline materials to neutralize the acids in the reaction mixture; however, it is generally best to neutralize the partially sulfated reaction product mixture before utilizing it for the final formulation of product from both a safety issue and sensitivity of other components of the final detergent formulation.) The neutralized result may then be used as is as the surfactant component of a laundry detergent in varying levels. (All of the following amounts are calculated on the basis of just the surfactant molecules and being exclusive of any water or sodium sulfate used or produced in the reaction.) The resulting partially sulfated mixture is used, based on the final laundry detergent product, in amounts of up to 50% of the laundry detergent, preferably in levels of from about 1% to about 45%, more preferably from about 2% to about 40%, still more preferably about 3% to about 30%, even more preferably from about 6% to about 25%, most preferably in amounts of about 6% to about 8%, about 10% to about 12%, about 15% to about 18%, about 20% to about 23%. Formulations wherein the surfactant component prepared above is used in amounts of about 6.5% to about 6.9% and about 21.9% and about 22.1%.

Alkylaryl-substituted EA's such as the commercially available blends of nonyl phenol nominally ethoxylated with 1.5, 2, 3, 4, 5, or 6 moles of ethylene oxide per mole nonyl phenol (e.g. NP-1.5, 2, 3, 4, 5, and 6 respectively, available from Union Carbide or Huntsman), and the commercially available blends of nonyl phenol nominally ethoxylated with 8, 8.5, 9 or 10 moles of ethylene oxide per mole of nonyl phenol (e.g., NP-8, 8.5, 9 and 10, respectively, available from Union Carbide or Huntsman), may be partially sulfated in the present process.

It will be understood that the partial sulfation reaction may be carried out employing either batch or continuous operations. The specific reaction times and temperatures may be varied, depending upon the particular reaction system utilized and the specific degree of sulfation desired for any particular application. It will also be understood that, if desired, the sulfation reaction may be carried out employing oleum (20–30%), liquid or gaseous SO.sub.3, or chlorosulfonic acid as the partial sulfating agent in lieu of concentrated sulfuric acid. The use of the latter material is, however, preferred since it obviates the necessity to employ special manufacturing equipment which may be necessary for the safe-handling and environmental control of fuming sulfuric acid or like reactants.

It is preferred to produce the sulfated/unsulfated blend by partial sulfation followed by neutralization as described more fully hereinabove. Alternatively, it is within the purview of the present invention to form the sulfated/unsulfated surfactant blends utilized herein by mixing the unsulfated components with their fully sulfated respective counterparts (with neutralization being conducted either before or after mixing.

Employing the partial sulfation technique, following sulfation the reaction mixture is neutralized in conventional manner with any desired base, e.g., with sodium hydroxide, soda ash, or other desired alkali metal or ammonium hydroxide or carbonate. Preferably, when the neutralized partially sulfated reaction mixture is to be utilized as the surfactant system in a dry powder detergent, the neutralization is effected simultaneously with dry blending of the surfactant with the further ingredients of the detergent formulation. Alternatively, the reaction mixture may be separately neutralized with an appropriate base, and the neutralized material thereafter blended with the further detergent ingredients.

Detergent formulations typically additionally contain one or more builder salts or compounds, alkali metal silicate corrosion inhibitors, and one or more further adjuvants such as pH buffering compounds, soil suspending agents, oxidizing agents, enzymes, optical brighteners, fillers, perfumes, coloring agents, or oleic acid for suds control and/or viscosity modification, or the like.

The builder salts, which peptize soil and remove water hardness ions, include various inorganic phosphates, pyrophosphates, borates, carbonates, bicarbonates, sesquicarbonates, silicates and zeolites, and organic compounds including citrates, EDTA (such as VERSENE available from Dow), NTA or alkanolamines. Various organic amines may also be incorporated as suds builders, including alkanolamides, amine oxides and alkanolamines. The soil suspending agents include colloids such as carboxymethylcellulose, polyvinyl alcohol, polymers such as polymer 445 (a polyarylate homopolymer having a molecular weight of about 3000 to about 8000, more specifically about 4000 to about 5000) or the like. Oxidizing agents which may be incorporated in such formulations for stain removal include the alkali metal perborates and percarbonates; enzymes such as the alkalases, proteases or the like can be added for similar purposes. Optical brighteners such as UNPA from Ciba (Stilbene chemistry Florescent whitening agents) more specifically a cyanuric chloride/diamino stilbene disulfonic acid compound. Dyes and fragrance are further optional ingredients.

Those skilled in the art will recognize that any of the preceding or various other recognized detergent ingredients may be blended with the surfactants of this invention to provide useful dry blended detergent formulations. Such further ingredients are further disclosed, for example, in the aforesaid Winston et al. application, the pertinent disclosure of which is incorporated by this reference herein.

The liquid formulations may additionally include sequestrants, viscosity modifiers, and any of the various adjuvants noted hereinabove. Typical constituents of liquid detergent formulations which may be thus admixed with the surfactants of the present invention are disclosed, for example, in Collins U.S. Pat. No. 3,869,399, the disclosure of which is additionally incorporated by this reference herein.

One of the primary advantages of the formulation of the instant invention is that while maintaining desired viscosity, performance and stability in a liquid laundry detergent product, the partially sulfated mixture of the invention is much more tolerant of soda ash than the same formulation having a partially sulfated composition of only one average ethoxylate of the alkylaryl-O-ethoxylate. In other words, a formulation with a low-ethoxylate and a high ethoxylate (each partially sulfated) is more tolerant of soda ash and the formulation is more stable than the same formulation with only a low ethoxylate (partially sulfated) or the same formulation with only a high ethoxylate (partially sulfated). This greater tolerance of soda ash means that the liquid laundry formulation of the invention can contain a greater amount of soda ash and as such the amount of the surfactants can be reduced. Since soda ash is much less expensive than the surfactants, this results in an overall lower cost for the final product per unit of use.

EXAMPLES

Example 1

Liquid Detergent A

A blend of 4.630 parts nonylphenolethoxylate (9ethoxy units) and 1.540 parts nonylphenolethoxylate (4 ethoxy units) is prepared and reacted with 1.130 parts of 99% sulfuric acid at a temperature of 130° F. for at least 1 minute to give a mixture of 3.670 parts of sulfated surfactant and 3.080 parts of unsulfated surfactant. The blend is then quenched with 50% aqueous sodium hydroxide which neutralizes the acid and results in sodium sulfate 0.810 parts and some water being present along with the surfactants. This mixture is used for the surfactant portion of the laundry detergent set forth below.

| Component | Starting % | Final % |
|---|---|---|
| Water | 88.322 | 89.599 |
| Versene 199 EDTA (37% aq.) | 0.200 | 0.074 |
| Sodium Hydroxide (50% aq.) | 1.300 | NA |
| NPE 9 | 4.630 | NA |
| NPE 4 | 1.540 | NA |
| Sulfuric Acid (99%) | 1.130 | NA |
| Anionic | NA | 3.670 |
| Nonionic | NA | 3.080 |
| Polymer 445 (48% aq) | 0.100 | 0.064 |
| Brightener UNPA slurry (40% aq.) | 0.125 | 0.050 |
| Salt | 0.600 | 0.600 |

-continued

| Component | Starting % | Final % |
|---|---|---|
| Sodium Carbonate | 2.000 | 2.000 |
| Dye | 0.003 | 0.003 |
| Fragrance | 0.050 | 0.050 |
| Sodium sulfate (neutralization product) | NA | 0.810 |
| Total | 100.000 | 100.000 |

Liquid Detergent B

A similar detergent is prepared according to the composition set forth below. The same procedures are used as in Detergent A, expect that amounts of the components are set forth below.

| Component | Starting % | Final % |
|---|---|---|
| Water | 69.845 | 73.031 |
| Versene 199 EDTA (37% aq.) | 0.150 | 0.056 |
| Sodium Hydroxide (50% aq.) | 3.666 | NA |
| NPE 9 | 15.107 | NA |
| NPE 4 | 5.035 | NA |
| Sulfuric Acid (99%) | 3.686 | NA |
| Anionic | NA | 11.970 |
| Nonionic | NA | 10.060 |
| Polymer 445 (48% aq) | 0.256 | 0.164 |
| Oleic Acid | 0.500 | 0.500 |
| Brightener UNPA slurry (40% aq.) | 0.300 | 0.120 |
| Sodium Carbonate | 1.000 | 1.000 |
| Dye | 0.005 | 0.005 |
| Fragrance | 0.450 | 0.450 |
| Sodium sulfate (neutralization product) | NA | 2.645 |
| Total | 100.000 | 100.001 |

Example 2

Detergent formulations C–I set forth in the table below were prepared and tested for performance, stability, and viscosity. Each formulation has a total of 6.75% of surfactant (combined non-ionic and its sulfate). Formulation C is an existing commercial product having dodecyl benzene sulfonic acid and NPE as the surfactant. Formulation D is of the present invention having nonylphenolethoxylate-9 and nonylphenolethoxylate-4 (and the corresponding sulfates). Formulations E and F differ from D in that they have either, but not both of the 9-ethoxylate or 4-ethoxylate (each with its corresponding sulfate). Formulation G (of the invention) differs from formulation D in that the 9-ethoxylate is replaced by a 14-ethoxylate and the 4-ethoxylate is replaced by a 1.5-ethoxylate (each with its corresponding sulfate). Formulations H and I hve either, but not both, of the 14-ethoxylate or the 1.5-ethoxylate.

| | Commercial Formulation C | | Invention Formulation D | |
|---|---|---|---|---|
| Component | Starting % | Final % | Starting % | Final % |
| Water | 87.95 | 91.61 | 78.92 | 89.35 |
| Versene 199 EDTA (37% aq.) | 0.20 | 0.07 | 0.20 | 0.07 |
| Sodium Hydroxide (50% aq.) | 0.47 | NA | 1.46 | NA |
| Polymer 445 (48% aq) | 0.10 | 0.06 | 0.10 | 0.06 |
| Dodecylbenzenesulfonic acid (96%) | 1.60 | 1.64 | — | — |
| NPE-9 | 5.11 | 5.11 | | |
| NPE/NPES Mix* | — | — | 7.30 | NA |
| Nonionic mix | — | — | NA | 3.08 |
| Anionic mix | — | — | NA | 3.67 |
| Brightener UNPA slurry (40% aq.) | 0.12 | 0.05 | 0.12 | 0.05 |
| Sodium chloride | 0.65 | 0.65 | 0.60 | 0.60 |
| Soda Ash (20%) | 3.75 | 0.75 | 11.25 | 2.25 |
| Dye | 0.003 | 0.003 | 0.003 | 0.003 |
| Fragrance | 0.05 | 0.05 | 0.05 | 0.05 |
| Sodium sulfate (neutralization product) | NA | NA | NA | 0.81 |
| Total | 100.000 | 100.000 | 100.000 | 100.000 |

*reaction product of

| | |
|---|---|
| NPE-9 | 4.63 |
| NPE-4 | 1.54 |
| Sulfuric Acid 99% | 1.13 |
| Total | 7.30 |
| Total Surfactant | 6.75 |

| | Comparison Formulation E | | Comparison Formulation F | |
|---|---|---|---|---|
| Component | Starting % | Final % | Starting % | Final % |
| Water | 79.14 | 89.35 | 78.22 | 89.35 |
| Versene 199 EDTA (37% aq.) | 0.20 | 0.07 | 0.20 | 0.07 |
| Sodium Hydroxide (50% aq.) | 1.26 | NA | 1.90 | NA |
| Polymer 445 (48% aq) | 0.10 | 0.06 | 0.10 | 0.06 |
| NPE/NPES Mix* | 7.28 | NA | 7.56 | NA |
| Nonionic mix | NA | 3.45 | NA | 3.33 |
| Anionic mix | NA | 3.30 | NA | 3.42 |
| Brightener UNPA slurry (40% aq.) | 0.12 | 0.05 | 0.12 | 0.05 |
| Sodium chloride | 0.65 | 0.65 | 0.60 | 0.60 |
| Soda Ash (20%) | 11.25 | 2.25 | 11.25 | 2.25 |
| Dye | 0.003 | 0.003 | 0.003 | 0.003 |
| Fragrance | 0.05 | 0.05 | 0.05 | 0.05 |
| Sodium sulfate (neutralization product) | NA | 0.81 | NA | 0.81 |
| Total | 100.000 | 100.000 | 100.000 | 100.000 |

| *in formulation E reaction product of | | in formulation F |
|---|---|---|
| NPE-9 | 6.28 | — |
| NPE-4 | — | 6.05 |
| Sulfuric Acid 99% | 1.00 | 1.50 |
| Total | 7.28 | 7.56 |
| Total Surfactant | 6.75 | 6.75 |

| | Invention Formulation G | | Comparison Formulation H | |
|---|---|---|---|---|
| Component | Starting % | Final % | Starting % | Final % |
| Water | 85.35 | 90.64 | 85.88 | 90.84 |
| Versene 199 EDTA (37% aq.) | 0.20 | 0.07 | 0.20 | 0.07 |
| Sodium Hydroxide (50% aq.) | 1.31 | NA | 0.91 | NA |
| Polymer 445 (48% aq) | 0.10 | 0.06 | 0.10 | 0.164 |
| alkylPE/alkylPES Mix* | 7.27 | NA | 7.14 | NA |
| Nonionic mix | NA | 3.10 | NA | 3.53 |
| Anionic mix | NA | 3.65 | NA | 3.22 |

-continued

| Component | Invention Formulation G | | Comparison Formulation H | |
|---|---|---|---|---|
| | Starting % | Final % | Starting % | Final % |
| Brightener UNPA slurry (40% aq.) | 0.12 | 0.05 | 0.12 | 0.05 |
| Sodium chloride | 0.60 | 0.60 | 0.60 | 0.60 |
| Soda Ash (20%) | 5.00 | 1.00 | 5.00 | 1.00 |
| Dye | 0.003 | 0.003 | 0.003 | 0.003 |
| Fragrance | 0.05 | 0.05 | 0.05 | 0.05 |
| Sodium sulfate (neutralization product) | NA | 0.77 | 0.81 | 0.57 |
| Total | 100.00 | 100.00 | 100.00 | 100.00 |

| *reaction product of | in formulation G | in formulation H |
|---|---|---|
| dodecylphenolethoxylate-14 | 4.65 | 6.42 |
| Octylphenolethoxylate-1.5 | 1.55 | — |
| Sulfuric Acid 99% | 1.07 | 0.72 |
| Total | 7.82 | 7.14 |
| Total Surfactant | 6.75 | 6.75 |

| Component | Comparison Formulation I | |
|---|---|---|
| | Starting % | Final % |
| Water | 83.49 | 89.78 |
| Versene 199 EDTA (37% aq.) | 0.20 | 0.07 |
| Sodium Hydroxide (50% aq.) | 2.59 | NA |
| Polymer 445 (48% aq) | 0.10 | 0.06 |
| alkylPE/alkylPES Mix* | 7.84 | NA |
| Nonionic mix | NA | 3.19 |
| Anionic mix | NA | 3.56 |
| Brightener UNPA slurry (40% aq.) | 0.12 | 0.05 |
| Sodium chloride | 0.60 | 0.60 |
| Soda Ash (20%) | 5.00 | 1.00 |
| Dye | 0.003 | 0.003 |
| Fragrance | 0.05 | 0.05 |
| Sodium sulfate (neutralization product) | NA | 1.63 |
| Total | 100.00 | 100.00 |

| *reaction product of | in formulation I |
|---|---|
| dodecylphenolethoxylate-14 | — |
| Octylphenolethoxylate-1.5 | 5.79 |
| Sulfuric Acid 99% | 2.05 |
| Total | 7.84 |
| Total Surfactant | 6.75 |

Results are reported below*:

| Formulation | Detergency Performance | Viscosity | Stability | | | |
|---|---|---|---|---|---|---|
| | | | RT | 122F | Refrigerator | Freeze/Thaw |
| D (invention) | comparable | comparable | pass | pass | pass | pass |
| E | inferior | inferior | pass | pass | pass | pass |
| F | inferior | inferior | fail | fail | fail | fail |
| G (invention) | comparable | comparable | pass | pass | pass | pass |
| H | inferior | inferior | pass | pass | pass | pass |
| I | inferior | inferior | fail | fail | fail | fail |

*Comparable and inferior are as compared to the commercial.

We claim:

1. A surfactant blend comprising an alkylaryl-O-ethoxylate having a relatively low ethoxy content and an alkylaryl-O-ethoxylate having a relatively high ethoxy content together with their respective sulfates wherein the alkyl portion of each ethoxylate and each sulfate is independently selected from the group consisting of alkyls of 6 to 12 carbon atoms; the aryl portion of each ethoxylate and each sulfate is independently selected from the group consisting of aryls having 6–10 carbon atoms; the low ethoxylate component and its sulfate independently have an average of from about 1 to about 6 ethoxy groups per molecule; and the high ethoxylate component and its sulfate independently have an average of from about 7 to about 14 ethoxy groups per molecule; wherein sum of the high ethoxylate component and its sulfate is present in a weight ratio of about 90:10 to 10:90 relative to the sum of the low ethoxylate component and its sulfate.

2. The surfactant blend of claim 1 wherein said alkylaryl-O-ethoxylates have as the alkylaryl group thereof a monoalkylphenyl group.

3. The surfactant blend of claim 1 wherein said alkylaryl-O-ethoxylates have as the alkylaryl species thereof an alkylaryl selected from the group consisting of octylphenyl, nonylphenyl, and dodecylphenyl.

4. The surfactant blend of claim 1 wherein said alkylaryl-O-ethoxylates have as the alkylaryl species thereof nonylphenyl.

5. The surfactant blend of claim 1 wherein said low ethoxylate and its sulfate each has an average of 1.5, 4, or 6 ethoxy groups per mole.

6. The surfactant blend of claim 1 wherein said low ethoxylate and its sulfate each has an average of 4 ethoxy groups per mole.

7. The surfactant blend of claim 1 wherein said high ethoxylate and its sulfate each has an average of 7, 9, or 14 ethoxy groups per mole.

8. The surfactant blend of claim 1 wherein said high ethoxylate and its sulfate each has an average of 9 ethoxy groups per mole.

9. The surfactant blend of claim 1 comprising at least a 4 component system comprising (a) a low ethoxylate ether of the formula (I)

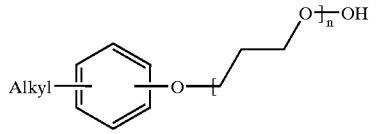

where n is an average of 4 and the alkyl is nonyl;

(b) a high ethoxylate ether of the formula (II)

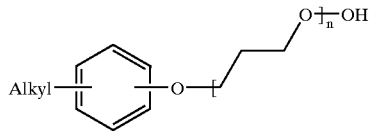

where n is an average of 9 and the alkyl is nonyl;

(c) a sulfate of component a of the formula (III)

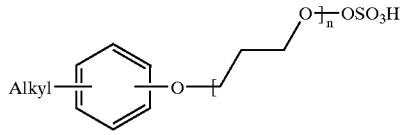

where n is an average of 4 and the alkyl is nonyl; and (d) a sulfate of component b of the formula (IV)

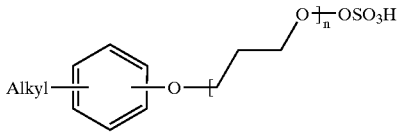

wherein n is an average of 9 and the alkyl is nonyl.

10. The surfactant blend of claim 9 where in each of the components (a)–(d), the alkyl substituent and the oxygen substituent on the respective phenyl rings are in a 1,4 relationship to one another.

11. The surfactant blend of claim 1 wherein the ratio of the total of all high ethoxylate components:the total of all low ethoxylates is about 75:25.

12. A neutralized surfactant blend comprising the unsulfated components of the blend of claim 1 and the alkali metal salts of the sulfated components of claim 1.

13. A detergent formulation comprising the surfactant blend of claim 1.

14. A detergent formulation comprising the neutralized surfactant blend of claim 12.

15. The detergent formulation of claim 14 further comprising:

water, a hard water ion chelator; a polyacrylate; a brightener; inorganic salt; soda ash; optionally dye; optionally fragrance; and optionally enzymes.

16. A method of making the surfactant blend of claim 1 comprising blending the low ethoxylate component in a weight ratio of from about 90:10 to 10:90 relative to the high ethoxylate component; reacting said blend with concentrated sulfuric acid to form a reaction product; and neutralizing said reaction product with a base.

17. A method of cleaning laundry comprising dissolving the detergent formulation of claim 13 in water and washing said laundry therein.

* * * * *